United States Patent [19]

Dowell

[11] 3,976,809

[45] Aug. 24, 1976

[54] COATING FOR METAL SURFACES AND METHOD FOR APPLICATION

[76] Inventor: Robert D. Dowell, 23321 Falena Ave., Torrance, Calif. 90501

[22] Filed: June 30, 1975

[21] Appl. No.: 591,537

Related U.S. Application Data

[62] Division of Ser. No. 387,717, Aug. 13, 1973, Pat. No. 3,911,891.

[52] U.S. Cl. ..... 427/34; 427/265; 427/287; 427/405; 427/419

[51] Int. Cl.[2] ..... F02F 3/12; F02F 3/02; B05D 1/08

[58] Field of Search ..... 427/34, 405, 419, 265, 427/287; 92/223

[56] References Cited

UNITED STATES PATENTS

| | | | |
|---|---|---|---|
| 3,006,782 | 10/1961 | Wheildon | 427/405 X |
| 3,010,480 | 11/1961 | Ragsdale | 427/58 X |
| 3,203,321 | 8/1965 | Rosen | 92/223 |
| 3,459,167 | 8/1969 | Briggs et al. | 92/223 X |
| 3,552,370 | 1/1971 | Briggs | 92/223 X |

*Primary Examiner*—James R. Hoffman
*Attorney, Agent, or Firm*—Lindenberg, Freilich, Wasserman, Rosen & Fernandez

[57] ABSTRACT

A coating is disclosed herein together with a method of forming that coating on metal surfaces of an internal combustion chamber. The coating is deposited for example, on the combustion surface of a piston to form a thermal barrier and thus enable higher temperatures to be sustained within the chamber. Combustion at higher temperatures achieves a more complete fuel burning thus increasing performance and reducing emissions. The coating is formed on the combustion surface by successively depositing layers of different materials preferably applied utilizing a plasma flame spray process. More particularly, the formation of the coating on the combustion surface involves preparing the surface as by grit blasting and then initially depositing a thin (approximately 0.001 – 0.003 inches) nickel aluminum alloy layer. Thereafter, a second thicker layer (approximately 0.003 – 0.006 inches) comprised primarily of said nickel aluminum alloy and refractory zirconium oxide is deposited followed by the deposition of a still thicker layer (approximately 0.008 – 0.010 inches) primarily of zirconium oxide.

6 Claims, 5 Drawing Figures

COATING FOR METAL SURFACES AND METHOD FOR APPLICATION

This is a division of application Ser. No. 387,717, filed Aug. 13, 1973, now U.S. Pat. No. 3,911,891.

BACKGROUND OF THE INVENTION

This invention relates generally to the art of coating and more specifically to a particular coating, and method of application thereof, suitable for coating the surfaces of an internal combustion chamber to enable operation thereof at temperatures greater than could otherwise be sustained.

It is generally known that more complete fuel burning can be achieved in an internal combustion engine if higher temperatures can be sustained within the combustion chambers. Since some heat loss occurs through all of the chamber surfaces, including the cylinder wall and head and piston combustion face, attempts have previously been made to form a coating on these surfaces to act as a thermal barrier to thus prevent heat flow out of the chamber. Such attempts have not, however, been successful due to various factors including the great difficulty of bonding suitable coatings to the surfaces in a manner which enables the bond to be maintained at elevated operating temperatures.

SUMMARY OF THE INVENTION

The present invention is directed to a coating suitable for application to metal surfaces of an internal combustion chamber and to a method for forming that coating on such surfaces.

Briefly, in accordance with the invention, the coating is formed by successively depositing layers of different materials preferably applied utilizing a plasma flame spray process. More particularly, the formation of the coating on the piston combustion face involves preparing the surface as by grit blasting and then initially depositing a thin (approximately 0.001 – 0.003 inches) metal layer, e.g. a nickel aluminum alloy, which exhibits a thermal expansion characteristic similar to that of the substrate. Thereafter, a second thicker layer (approximately 0.003 – 0.006 inches) comprised primarily of a mixture of said first metal layer and a refractory material such as zirconium oxide is deposited followed by the deposition of a still thicker layer (approximately 0.008 – 0.010 inches) of refractory material which last layer minimizes heat loss to the substrate. The middle or transition layer, preferably exhibits a thermal expansion characteristic between that of said first and third layers and as a consequence relieves stresses which might otherwise be created at elevated operating temperatures.

DESCRIPTION OF THE PREFERRED EMBODIMENT

The present invention is directed to a coating and a method of applying that coating to metal surfaces, particularly metal surfaces forming the chamber of an internal combustion engine.

It is generally known that more complete fuel burning can be achieved in an internal combustion engine if higher temperatures can be sustained within the combustion chambers. Since the various surfaces exposed in the combustion chamber are generally formed of good heat conducting metal such as aluminum or iron alloys, significant amounts of heat are transferred via these elements out of the combustion chambers. The present invention is particularly directed to a coating applicable to the metal surfaces within the combustion chamber, particularly the piston end face, to considerably reduce heat loss and thereby enable the temperatures within the chambers to be sustained at higher levels than would otherwise be possible. In order for a coating to be suitable to the aforedescribed application, it is necessary that it be capable of being very tightly bonded to the metal surfaces, in addition to it, of course, having to exhibit a high thermal barrier characteristic. Refractory materials which generally exhibit suitable thermal barrier characteristics often cannot be adequately bonded to metal surfaces exposed to elevated temperatures because of the significant differences in thermal expansion characteristics.

In accordance with the present invention, a coating is disclosed comprised of three layers. The material selected for the first layer, which is bonded directly to the metal surface, has a thermal expansion characteristic close to that of the metal surface. A third, or outside layer material is selected which has excellent thermal barrier characteristics and a middle or intermediate layer is selected which exhibits a thermal expansion characteristic between that of the first and third layers for the purpose of relieving mechanical stresses therebetween which might otherwise be created in the presence of temperature gradients.

Figure 1:
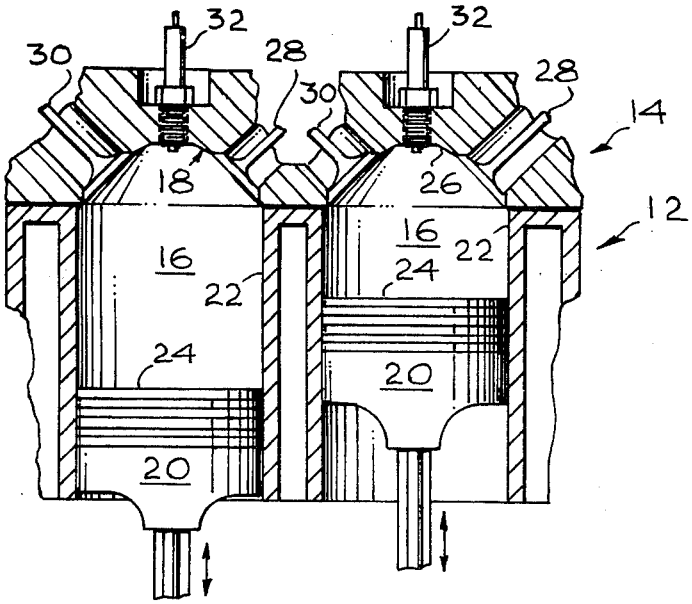
FIG. 1 is a schematic illustration of a portion of an internal combustion engine showing the elements of two combustion chambers.

Prior to considering the specifics of the coating in accordance with the present invention and the method of applying it, attention is called to FIG. 1 which schematically illustrates the crosssection of a portion of a typical internal combustion engine. The engine is comprised of a block 12 and a head 14 mounted on and secured to the block. A plurality of cavities 16 extend inwardly from the upper surface of the block 12. Dome portions 18 of the head 14 cover and closes the cavities 16.

A piston 20 is mounted within the cylindrical cavity 16, for reciprocal movement toward and away from the dome 18, defining a combustion chamber formed essentially by the wall 22 of the cylindrical cavity, the substantially flat end face 24 of the piston, and the surface 26 of the dome. As is well known, the combustion chamber additionally normally includes an inlet valve 28 and an exhaust valve 30 as well as a spark plug 32. Since heat loss can, and does, occur through all of the surfaces exposed to the combustion chamber, the thermal barrier coating in accordance with the present invention can be advantageously used on all of these surfaces, hereinafter referred to as the combustion surfaces. Although the coating can be advantageously utilized on all of the combustion surfaces, the detailed description herein of the method of applying the coating will be restricted to its application to the end face 24 of the piston 20. However, it will be understood that the coating can be similarly applied to other surfaces.

Briefly, application of the coating in accordance with the present invention to the piston end face comprises primarily the steps of (1) initially preparing the piston end face surface for coating, (2) applying the first layer, (3) applying the second layer, (4) applying the third layer, and (5) cleaning and polishing.

The piston surface is prepared initially by cleaning it, preferably in a suitable vapor degreasing apparatus utilizing for example, perchlorethylene. After being cleaned, the portions of the piston to be coated are grit blasted. In order to do this, the piston 20 is loaded into a specially made fixture 36 illustrated in FIGS. 2A and 2B. The fixture 36 is comprised of a top plate 38 secured by fixed standards 40 to a turntable 42. The plate 38 has a center opening 44 below which the piston 20 is supported on a mounting structure 46. The mounting structure 46 can elongate as represented by the arrows, to press the piston 20 up into tight engagement with the underside of plate 38. In order to remove the piston 20 from the fixture 36, the mounting structure 46 is shortened so that the piston can be slid out.

The opening 44 and plate 38 is precisely dimensioned so as to have a diameter slightly smaller than the diameter of the piston end face. As an example, it is desirable to leave a narrow arcuate area, approximately 1/32nd inch in width, immediately adjacent the outer circumference of the piston end face, free of coating in order to establish a better bond between the coating and the piston end face.

Figure 2A:
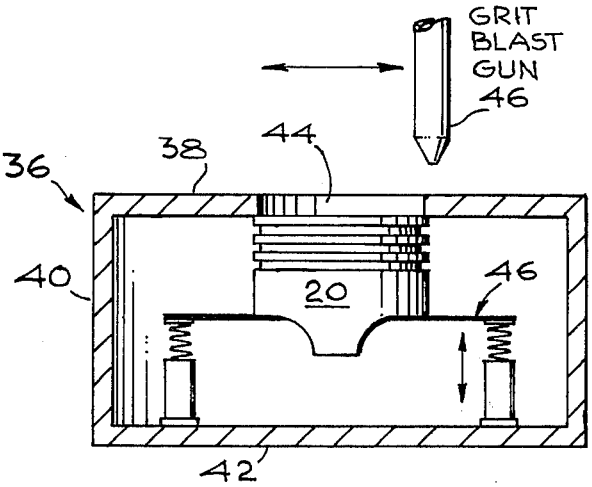
FIG. 2A is a schematic illustration showing a step in the method of applying a coating in accordance with the present invention to a piston.
Figure 2B:
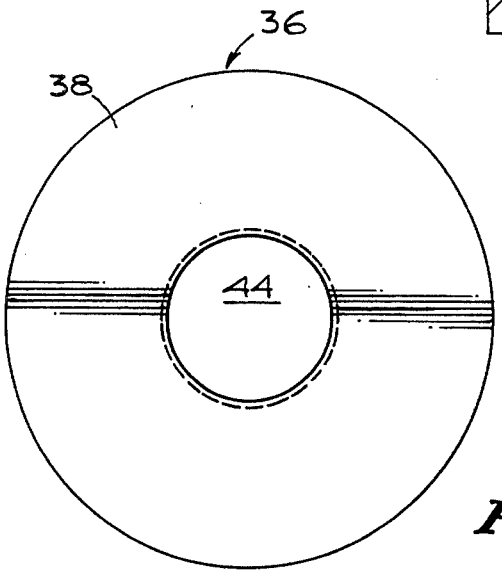
FIG. 2B is a plan view of the apparatus shown in FIG. 2A.

With the piston 20 mounted in the fixture 36 as shown in FIG. 2A, the piston end face surface is grit blasted using for example an aluminum oxide grit having a mesh size of 46/70. The grit blast gun 46 should be approximately 3 inches above the surface of the piston and discharge the grit at approximately 35 pounds per square inch. As represented by the arrow in FIG. 2A adjacent the grit blast gun, the gun 46 is moved back and forth over the surface of the piston 20 to develop a substantially uniform surface roughness of 150/300 RMS.

Subsequent to the preparation of the piston end face surface by cleaning and grit blasting, the surface is ready for application of the three successive coating layers. In accordance with the preferred method of applying the coating, all three layers are applied in substantially the same manner utilizing the same apparatus. More particularly, each of the coating layers is applied utilizing a plasma flame spray apparatus, for example, of the type shown in U.S. Pat. No. 3,145,287. This apparatus is capable of producing and controlling a high velocity, high temperature inert gas stream for long periods. Typically, gas velocities of 1,000 feet per second at 12,000° to 30,000° Fareinheit can be produced. The hot gas stream is used to melt and accelerate at high velocities the material to be deposited which is usually introduced into the apparatus in powder form. When the molten particles impact on the surface to be coated (substrate), they form a dense high purity coating which does not metallurgically effect the substrate in that there is no heat effected zone and no distortion.

Figure 3:
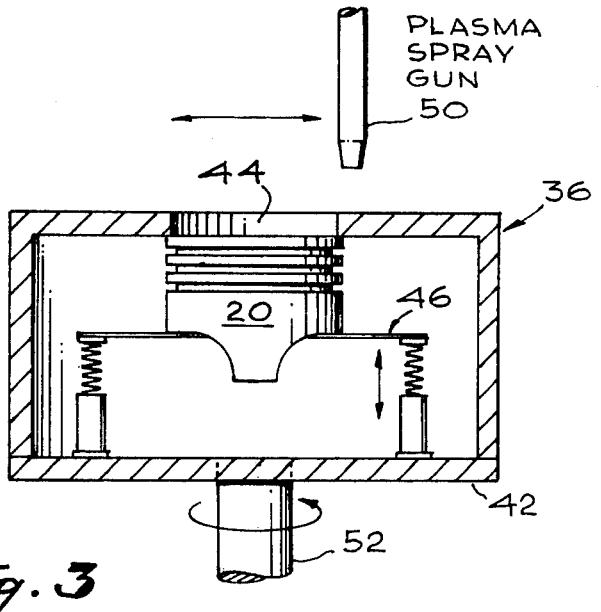
FIG. 3 is a schematic illustration typical of a further step in the application of the coating in accordance with the invention to a piston.

The coating layers are applied to the piston end face utilizing the fixture 36 as shown in FIG. 3. Whereas, the grit blast gun was moved across the piston face in FIG. 2A along two perpendicular axes, the preferred manner of depositing the coating material on the piston end face, as shown in FIG. 3, involves moving the plasma spray gun 50 along one axis only while simultaneously rotating the entire fixture 36 by shaft 52 secured to turntable 42. Alternatively, the spray gun 50 can be moved across the face of the piston along two perpendicular axes.

In describing the steps of applying the coating layers to the piston end face, various parameters will be recited with the assumption being made that a particular plasma flame spray gun and powder feeder, both sold commercially by Metco, Inc., is being employed. The gun type is 3MB. The powder feeder type is 3MP. The cathode type is 3MllA and the rectifier utilized is 4MR or 6MR.

The initial coating layer applied directly to the piston end face is a bonding layer, preferably a nickel aluminum alloy. The powder employed is comprised of approximately 95% nickel and 5% aluminum with a mesh size range from −170 to +325.

The various plasma spray parameters preferably employed in depositing the first coating layer are as follows:

| | | | | |
|---|---|---|---|---|
| CARRIER GAS | | | | |
| Nitrogen | | | | |
| ARC GAS | | | | |
| | Type | Regulator | Console | Flow |
| Primary | Nitrogen | 50 ± 2PSI | 50 ± 2PSI | 150 SCFH |
| Secondary | hydrogen | 50 ± 1PSI | 50 ± 1PSI | 10 SCFH |
| POWER | | | | |
| Operating: 500 | Amps: | 65–67 | Volts | |
| POWER FEEDER | | | | |
| Gas: 37 SCFH | | RPM: 16 | Port No. 2 | |
| Amps: | | Spray Rate: | 68 grams/min Meter Wheel S | |
| STANDOFF | | | | |
| Gun to Work Distance: | | 5 in. | | |
| NOZZLE | | | | |
| Type G | | | | |
| ADDITIONAL INSTRUCTIONS | | | | |
| Preheat to 150 F. | | Max. Part Temp. | 350°F Steel<br>200°F Aluminum | |
| Surface Speed: 150 ft/min. | | | | |

Figure 4:
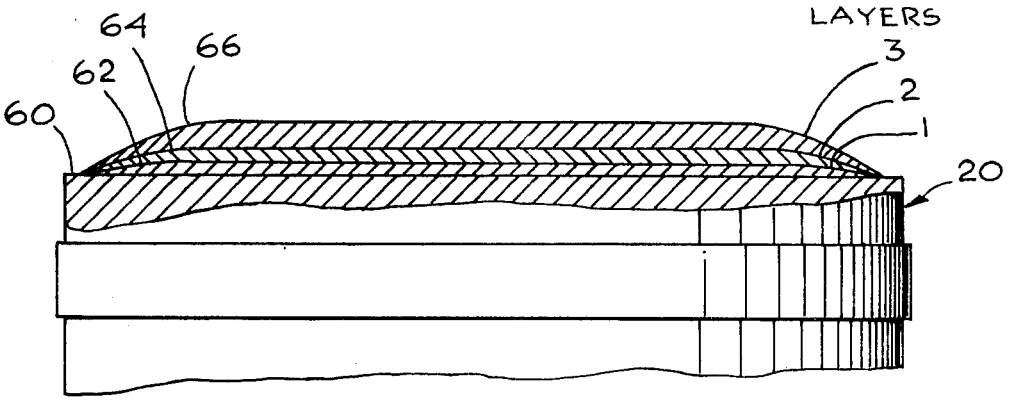
FIG. 4 is an enlarged cross-sectional view illustrating the various layers of the coating applied to the piston end face.

It has previously been mentioned that a narrow arcuate area immediately adjacent the edge of the piston end face is left free of coating to assure better bonding of the coating to the piston. This area, which may have a width of approximately 1/32 of an inch, is represented by numeral 60 in FIG. 4. To further assure good bonding, the thickness of each layer is tapered gradually proximate to the edge thereof. The tapering of layer 1 in FIG. 4 is represented by number 62. The variation in thickness of the layer to establish the tapering is achieved by varying the speed of the plasma spray gun as it moves across the piston end face or by varying the rotational speed of the turntable depending on the position of the gun. For example, if the plasma spray gun is moving faster adjacent the edge. It will deposit a lesser thickness of material than it will when it is moving more slowly toward the center of the piston. The number of passes of the gun across the piston determines the thickness of the coating layer applied. Preferably, the nickel aluminum alloy (layer 1) should be applied to a thickness of approximtely 0.001 – 0.003 inches.

After the first coating layer has been applied, a second coating layer is applied in the identical apparatus as illustrated in FIG. 3. The powder utilized to apply the second coating layer in accordance with the present invention consists of a blend of approximately 35% of the nickel aluminum powder utilized in depositing the first layer and about 65% of a primarily zirconium oxide material, which as will be seen hereinafter, is utilized as the third layer.

The adjustable parameters for depositing the second layer are substantially as follows:

CARRIER GAS
Argon
ARC GAS

| | Type | Regulator | Console | Flow |
|---|---|---|---|---|
| Primary | Nitrogen | 50 ± 2PSI | 50 ± 2PSI | 75 SCFH |
| Secondary | Hydrogen | 50 ± 1PSI | 50 ± 1PSI | 15 SCFH |

POWER
Operating: 500 Amps 75–85 Volts
POWER FEEDER
Gas 40 SCFE RPM 80 Port No. 2
AMPS Spray Rate 76 grams/min Meter Wheel S
STANDOFF
Gun to Work Distance 5.5 ± 0.5 in.
NOZZLE
Type G
ADDITIONAL INSTRUCTIONS
Preheat to 150F Max. Part Temp. 300 F
Surface Speed 150 ft/min.

The thickness of the second layer should also be tapered adjacent the edge thereof as shown at 64. The thickness of the second layer is preferably somewhat greater than the first layer, i.e. approximately 0.003 – 0.006 inches.

Deposition of the third layer utilizes a powder comprised primarily of zirconium oxide (approximately 93%), calcium oxide (approximately 5%), aluminum oxide (approximately 5%) and silicon dioxide (approximately 0.4%) plus traces of other oxides and using a fully lime or yttria stabilizer. The powder mesh size is approximately –200 +325 RD. The thickness of the third layer is also tapered adjacent the edge thereof as shown at 66. The thickness of the third layer should be somewhat greater than that of the second layer, i.e. approximately 0.008 – 0.010 inches.

The adjustable parameters for depositing the third layer are substantially as follows:

CARRIER GAS
Argon
ARC GAS

| | Type | Regulator | Console | Flow |
|---|---|---|---|---|
| Primary | Nitrogen | 50 ± 2PSI | 50 ± 2PSI | 75 SCFH |
| Secondary | Hydrogen | 50 ± 1PSI | 50 ± 1PSI | 15 SCFH |

POWER
Operating: 500 Amps 75–85 Volts

-continued

POWDER FEEDER
Gas 40 SCFH RPM 26 Port No. 2
AMPS Spray Rate 90 grams/min. Meter Wheel S
STANDOFF
Gun to Work Distance 2.5 ± 0.5 in.
NOZZLE
Type G
ADDITIONAL INSTRUCTIONS
Preheat to 150 F. Max Part Temp 300 F
Surface Speed 150 ft./min.

After the three layers have been deposited as shown in FIG. 4, it is preferable to polish the piston face with an appropriate polishing wheel such as Tycro 904188 to remove any loose material.

Although the materials and parameters disclosed herein have been found to be preferred for coating aluminum pistons intended to operate in typical internal combustion chambers, it is recognized that selected different materials and parameters could also be used. For example, in lieu of the nickel aluminum alloy disclosed herein for use as layer 1, a nickel chrome alloy could be substituted. Certain other refractory materials such as magnesium, zirconate could be substituted for zirconium oxide, disclosed herein, for the third layer with some degradation of effectiveness.

From the foregoing, it should be recognized that a coating, and a method of applying that coating to metal surfaces, particularly metal surfaces used within an internal combustion chamber, has been disclosed herein for enabling operating temperatures within the combustion chamber to be sustained at a higher level than would otherwise be feasible. The coating involves the application of three distinct layers; a first layer having a thermal expansion characteristic similar to that of the substrate so as to provide good bonding, a third layer exhibiting a very high thermal barrier characteristic, and a second layer having a thermal expansion characteristic intermediate that of the first and third layers to relieve mechanical stresses which might otherwise be encountered in the presence of temperature gradients. As a consequence of enabling higher temperatures to be sustained within the combustion chamber, more efficient fuel burning is achieved resulting in increased performance and better fuel economy along with a reduction in emissions.

What is claimed is:

1. A method of depositing a thermal barrier coating on a metal surface comprising the following steps:

depositing on said metal surface, a first layer constituting an alloy comprised of approximately 95% nickel and 5% aluminum;

depositing on said first layer, a second layer constituting a blend of approximately 65% of a zirconium oxide mixture and 35% of said first layer alloy; and depositing on said second layer, a third layer constituting primarily zirconium oxide.

2. The method of claim 1 wherein said second layer is deposited to a greater thickness than said first layer and said third layer is deposited to a greater thickness than said second layer.

3. The method of claim 1 wherein said deposition steps comprise depositing material in a molten state from a plasma flame spray gun.

4. A method of fabricating a piston for use in an internal combustion chamber including the steps of:

depositing on the piston end face within an area spaced inwardly from the circumferential edge of said end face, a first layer constituting an alloy exhibiting a thermal expansion characteristic substantially the same as that exhibited by said piston material;

depositing a second layer on said first layer; and depositing a third layer on said second layer having a thermal barrier characteristic substantially greater than that of said piston material and wherein said second layer has a thermal expansion characteristic between that of said first and third layers.

5. The method of claim 4 wherein said second layer is deposited to a greater thickness than said first layer and said third layer is deposited to a greater thickness than said second layer.

6. The method of claim 4 wherein each of said first, second, and third layers is deposited so that the thickness thereof is tapered adjacent to the edges thereof.

* * * * *